US006716139B1

(12) United States Patent
Hosseinzadeh-Dolkhani et al.

(10) Patent No.: US 6,716,139 B1
(45) Date of Patent: Apr. 6, 2004

(54) METHOD AND PORTABLE TRAINING DEVICE FOR OPTIMIZING A TRAINING

(75) Inventors: Boris Hosseinzadeh-Dolkhani, Froschammerstr. 6, 80807 Munchen (DE); Wolfgang Schiller, Kirchenstr. 71, 82110 Germering (DE); Marc Rummel, Munich (DE)

(73) Assignees: Boris Hosseinzadeh-Dolkhani (DE); Wolfgang Schiller (DE); Fredy Osterberger (DE)

( * ) Notice: Subject to any disclaimer, the term of this patent is extended or adjusted under 35 U.S.C. 154(b) by 167 days.

(21) Appl. No.: 09/712,086

(22) Filed: Nov. 14, 2000

(30) Foreign Application Priority Data

Nov. 16, 1999 (DE) ..... 199 55 720

(51) Int. Cl.[7] ..... A63B 69/00
(52) U.S. Cl. ..... 482/1; 482/8; 482/9
(58) Field of Search ..... 482/1–9, 900–902; 73/379.01–379.03; 601/23

(56) References Cited

U.S. PATENT DOCUMENTS 5,137,501 A * 8/1992 Mertesdorf ..... 482/57
5,728,027 A * 3/1998 Sinaiko ..... 482/4
6,251,048 B1 * 6/2001 Kaufman ..... 482/8
6,312,363 B1 * 11/2001 Watterson et al. ..... 482/54

FOREIGN PATENT DOCUMENTS

| | | |
|---|---|---|
| DE | 3543716 A 1 | 6/1987 |
| DE | 41 41 109 A 1 | 6/1993 |
| DE | 195 39 351 A 1 | 5/1997 |
| DE | 198 31 358 A 1 | 1/1999 |
| DE | 195 22 958 C 2 | 5/1999 |
| DE | 199 55 720.9 | 11/1999 |

* cited by examiner

*Primary Examiner*—Glenn E. Richman
(74) *Attorney, Agent, or Firm*—Eugene Stephens & Associates

(57) ABSTRACT

The present invention provides a portable training device for optimizing a training comprising a sound playback means, a microprocessor, and a means for detecting parameters inherent to the body of the user, said detecting means being connected with the microprocessor for data communication. The training device further comprises a converter means controlled by the microprocessor and connected to the sound playback means for converting the detected values of the said parameters into verbal training information for the training person and outputting them by the sound playback means.

29 Claims, 2 Drawing Sheets

METHOD AND PORTABLE TRAINING DEVICE FOR OPTIMIZING A TRAINING

FIELD OF THE INVENTION

The present invention relates to a portable training device comprising a sound playback means, eg., a music playback device and a training system and method for optimizing a training.

BACKGROUND OF THE INVENTION

Recently it has come into fashion to practice fitness, e.g. jogging, as leisure activities for compensation to everyday work and also for building up the personal condition. In order to make these possibly monotone sporting activities more attractive and diversified, special music playback devices have been developed by the entertainment industry, which can be carried on the body during the fitness activity (e.g. jogging), so that music can be listened to simultaneously. Such special music playback devices have become commonly known as WALKMAN or DISCMAN (registered trademarks of Sony Corporation); appropriate radio devices have been developed, too. However, these music playback devices have the drawback of merely serving for reproducing corresponding media, such as cassettes or compact disks, which for example store music or audio plays. The played pieces of music and texts correspond to the preferences of each sportsman and are in no way associated with the achieved training of the personal condition and fitness.

SUMMARY OF THE INVENTION

Thus it is the object of the present invention to provide a portable training device, a training system and a training method which enable a purposeful and controlled and thus optimized training of the user. This object is achieved with the features of the claims.

According to a first aspect, the invention provides a method of optimizing a training comprising the step of:

a) detecting parameters inherent to a person's body during a training; said method being characterized by the steps of:

b) converting data corresponding to the detected parameters inherent to a person's body into verbal training information for the training person; and c) outputting said verbal training information by a portable sound playback means.

According to a second aspect, the invention provides a portable device for optimizing a training comprising a sound playback means, a microprocessor, and a means for detecting parameters inherent to a training person's body, said detecting means being connected with the microprocessor for data communication, said portable training device being characterized by converter means controlled by the microprocessor and connected to the sound playback means for converting the detected values of said parameters into verbal training information for the training person and for outputting them by the sound playback means.

According to a third aspect, the invention provides a training system comprising a portable device for optimizing a training, said portable device comprising a sound playback means, a microprocessor, a means for detecting parameters inherent to a training person's body, said detecting means being connected with the microprocessor for data communication, and converter means controlled by the microprocessor and connected to the sound playback means for converting the detected values of said parameters into verbal training information for the training person and for outputting them by the sound playback means. The training system further comprises a base station for providing training information, said base station being connectable with said portable device.

To achieve the above objectives, the invention is based on the idea of providing a training program that can be combined or compiled individually and listened to by a user during the training (e.g., a music compilation) and of providing a portable training device that has sound playback means for playing the training program in the form of music or texts and the capability to detect the actual training course and to output via the sound playback means verbal training information corresponding to this training course to the user for training purposes.

According to the invention the term "training information" indudes all kinds of information which can be used as training information or training instructions, respectively, for optimizing a training, e.g. instructions in a spoken form, preferably assisted by visual signals or information etc. The output of training information in verbal form enhances and optimizes the training as information in verbal form is much more motivating to the user as compared to, e.g., mere displays.

According to the invention the portable training device comprises, besides the sound playback means, a microprocessor or microcomputer, respectively, and a training course detecting means in data communication with the microprocessor. The training course detecting means detects parameters inherent to the training person during a training. The training course detecting means is, for example, a pulsimeter, a pulsoxymeter, a chronometer, a timer, or a pedometer.

The sound playback means is preferably a MP3 player or a device using similar data formats, a DISCMAN, a portable DAT device, or a portable MiniDisc device. The sound playback means is preferably insensitive to shock.

Verbal information (for example, "Your pulse frequency is 110.") corresponding to the detected pulse is outputted to the user via the sound playback means for informing the user about his/her present physical condition. This information is presented to the user on a regular basis, e.g., every minute, or on demand, for example by means of a button or switch provided on the portable training device.

For example, by use of a chronometer or timer the user can perform his training in certain intervals, the duration of which is predetermined by the chronometer/timer and verbally signaled to him. The indication of the detected training course, i.e. time intervals, pulse frequency, etc. can be provided by a voice synthesizer and preferably additionally by a visual signal generating means. For example, a light emitting diode is provided that assists and supports the verbal indication or information to the user. Alternatively, a display, e.g. integrated in glasses (e.g., sun glasses) worn by the user is used for visually informing the user about his/her present status.

The microprocessor/microcomputer receives the detected training course signal, i.e. the parameter signal of the detected parameter, and converts this into corresponding training information and transmits it to a signal means, e.g. a voice synthesizer, for verbally informing the user of the detected parameters. Thus corresponding training information can be communicated to the user on the basis of the determined data (pulse frequency, oxygen contact of the blood, time characteristic, distances, etc.). If the user for example listens to music by means of a head set during the training, the running program can be interrupted temporarily for transmitting the training information to inform the user about his/her present physical condition. The portable training device according to the invention thus outputs by means of voice output training information to the user, e.g. information about pulse, elapsed time, pace information (e.g. elapsed distance), information about individual training units, etc.

In a preferred embodiment the user is informed about further training units by means of voice. In this way the user can be prompted based on the previous training course to accelerate or decelerate the speed, to take a break or to change the previous training in any other way. Again, the advantage of the present invention is that the information or instructions, respectively, is given to the user in verbal form (i.e., a virtual personal coach) which is much more motivating to the user than mere signals like beeps.

Thus, the training information is combined with the voice of a moderator or coach so that a virtual coaching is realized during the training.

Alternatively the microprocessor/microcomputer influences the sound playback means (e.g. a MP3 player) so that the played music is modified for example by selecting a faster/slower title.

A music playback means according to the invention preferably comprises a means for outputting a beat so that the user is given a predetermined selectable rhythm for performing his training. This beat can preferably be provided variably to influence the training course and the training speed, respectively. In a particular preferred embodiment, the outputted beat corresponds to the cardiac rhythm of the user so that he can train according to his personal rhythm. The music played by the training device or the music playback means is for example pulse controlled or running controlled.

According to the third aspect of the invention, the training device can be connected with a base station, for example a computer having Internet access, so that the portable training devil can be provided with training programs via the connection with the base station. The Individual training programs can be combined or compiled in the Internet in form of music compilations for particular training desires and downloaded. Alternatively a particular training software can first be downloaded from the Internet to the personal computer. In this way special or individual training programs and training courses, respectively, can be processed and combined and then played by a MP3 player. Thus different training desires can be considered, e.g training duration, training intervals, training intensity (speed, increases), and music direction (jazz, classics, etc.). Alternatively, with the training system according to the invention, already compiled training courses are provided. Preferably, when preparing the individual training program, the user can select a specific voice (e.g., drill sergeant, soft voice etc.) he/she prefers for the verbal information that is communicated to the user during the training. This selection is then transmitted to the portable training device along with the training program.

According to a further prefered embodiment the training device according to the invention comprises a radio transmitting means so that during a training in groups one of the users can act as a trainer or coach and transmit corresponding instructions via radio to the remaining training devices and their users. Likewise the "coach device" can transmit corresponding instructions automatically to the other devices without interconnection of the user/coach.

According to a further preferred embodiment, the training device comprises a means for storing personal user data. These are output from the training device during the training and can be received by other training devices. Received personal data of another user can be compared with the user's own personal data (e.g. hobbies) in the user's own training device. If the compared data match at least partially, this is indicated to the user by a corresponding signal.

The training information and training courses, respectively that can be compiled at the base station of the training system and transmitted to the training device are preferably adapted for different kinds of sport such as jogging, marathon training, cycling, rowing, fitness programs (warm up followed by alternating units of running and gymnastics, etc.). roller blading.

According to the invention, prior to the training, music compilations are provided (in the Internet) at a base station (e.g. computer having Internet access) which then can be combined individually, downloaded, and employed for training on a playback device (MP3 player). Preferably, the parameters detected during the training are stored in a memory of the portable training device and are transferred to the base station once the training device is again connected with the base station. In the base station, the detected data of the preceding training unit are analyzed. Based on the outcome of this analysis and based on personal data (e.g., age, gender, etc.) and on the selected kind of sport, a modified training program is offered to the user as a further means to improve and optimize the user's training and physical condition.

DESCRIPTION OF THE PREFERRED EMBODIMENTS

Figure 1:
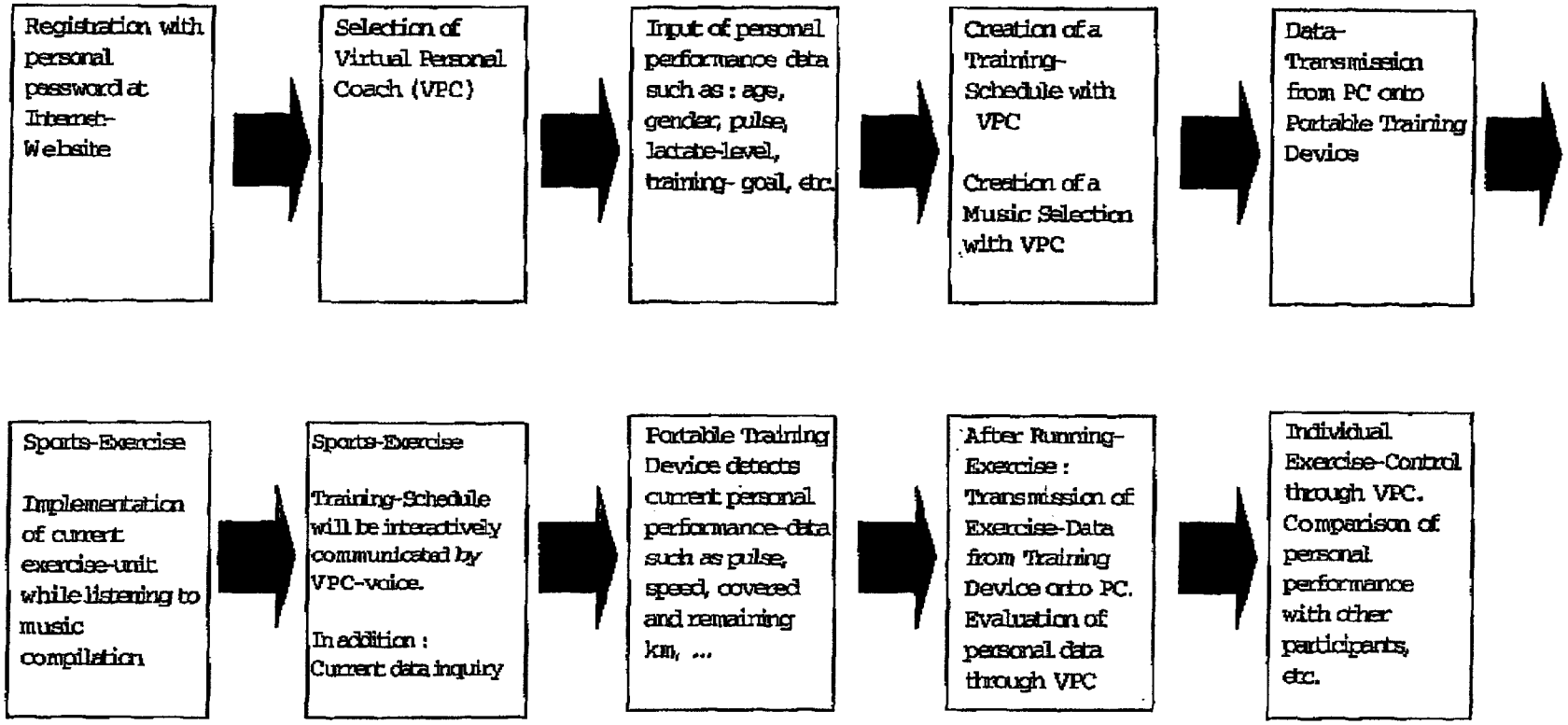
FIG. 1 is a block diagram showing a preferred embodiment of the training method according to the invention.

According to a preferred method of the present invention as shown in FIG. 1, a user first registers with a personal password at an Internet website. The user then selects a virtual personal coach, i.e., the user selects a specific voice (e.g., drill sergeant) for the training information/instructions communicated during the training. In the next step, the user is asked for personal data such as age, gender, training goal, etc. which allows the training system to assist the user in creating a music compilation or training schedule for specific training units. The selected data are then transferred from the PC (base station) to the portable training device, and the user can start the individual training. While the user is listening to the individual music compilation, the detected parameters are communicated to the user along with instructions regarding further training units. According to this preferred method, the detected data are stored in a memory of the portable training device and are transferred to the base station after the training is completed. These data are then analyzed at the base station. For example, the data are compared with the data of previous exercises or with data of other users.

Figure 2:
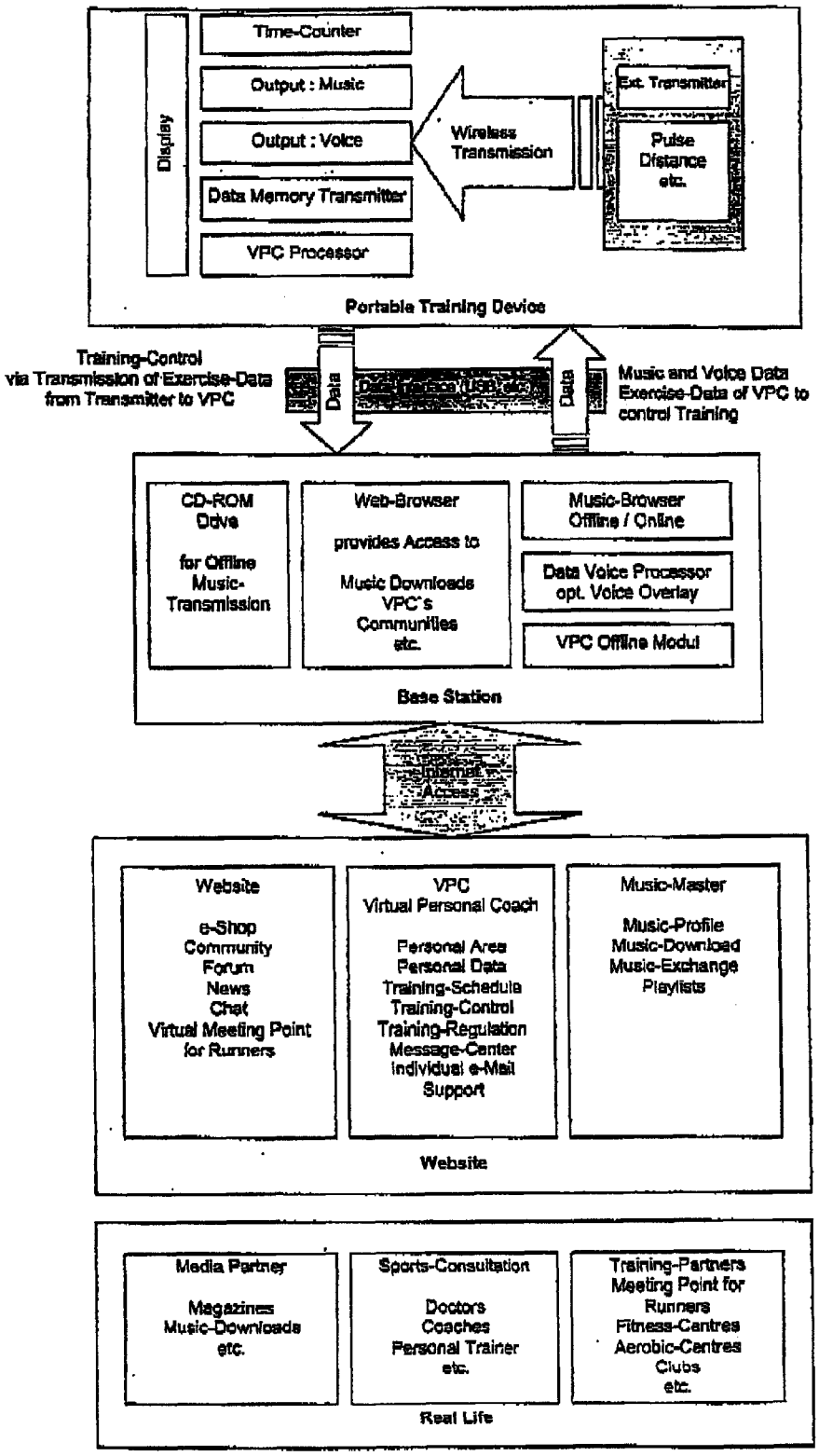
FIG. 2 is a block diagram showing a preferred embodiment of the training system according to the invention.

FIG. 2 shows the training system according to a preferred embodiment of the present invention. On top of FIG. 2, the portable training device is shown. According to this specific embodiment, the portable training device comprises a parameter detecting unit that communicates with the microprocessor of the device by wireless transmission. Furthermore, a display is provided, e.g. for showing the track number or title of the played music. The training device further comprises an output unit comprising an output sub-unit for music and a sub-unit for the verbal information, a time counter, and a data memory transmitter. The portable training device is adapted for a data transfer with a base station which is shown as a computer with an Internet browser for accessing an Internet website. At this website, the individual personal data can be entered, the training schedule with a sequence of training units can be created, and the music compilations can be prepared.

What is claimed is:

1. Method of optimizing a training comprising the steps of:

detecting parameters inherent to the body of a user during a training;

converting data corresponding to the detected parameters into verbal training information for the user; and outputting music and said verbal training information to the user by a portable sound playback device.

2. Method according to claim 1, wherein the verbal training information indicates the detected values of the body's inherent parameters to the user.

3. Method according to claim 1, wherein the verbal training information includes training instructions for further training based on the detected values.

4. Method according to claim 1, further comprising the steps of:

providing an individual training program on a computer in the form of a music compilation prior to the training; and transmitting the training program to the portable sound playback device.

5. Method according to claim 4, further comprising the step of:

influencing the individual training program provided in the form of a music compilation in the sound playback device dependent on the detected values of the body's inherent parameters.

6. Method according to claim 1, wherein the verbal training information is outputted simultaneously with other output of the sound playback device or the other output of the sound playback device is interrupted during the output of the verbal training information.

7. Portable training device for optimizing a training comprising:

a sound playback device adapted for playback of music;

a microprocessor;

a detector that detects parameters inherent to the body of a user, said detector being connected with the microprocessor for data communication; and a converter controlled by the microprocessor and connected to the sound playback device for converting detected values of said parameters into verbal training information for the user and for outputting the information by the sound playback device.

8. Portable device according to claim 7, wherein the verbal training information indicates the detected values of the body's inherent parameters to the user.

9. Portable device according to claim 7, wherein the verbal training information indicates instructions for further training to the user based on the detected values of the body's inherent parameters.

10. Portable device according to claim 7, wherein the detector comprises at least one of a pulsimeter, a pulsoxymeter, a chronometer, a timer and a pedometer.

11. Portable device according to claim 7, wherein the converter comprises a voice synthesizer.

12. Portable device according to claim 7, wherein the sound playback device is a MP3 player, a disc player, a DAT device, or a MiniDisc device.

13. Portable device according to claim 7, further comprising a connector that connects the portable device with a base station.

14. Portable device according to claim 13, wherein the base station is a computer preferably having Internet access.

15. Portable device according to claim 13, wherein the sound playback device is adapted to reproduce an individual training program in the form of a music compilation transmitted from the base station.

16. Portable device according to claim 15, wherein the microprocessor influences the music compilation dependent on the detected values of the body's inherent parameters.

17. Portable device according to claim 7, wherein the verbal training information is further assisted visually.

18. Portable device according to claim 7, further comprising a means for storing and transmitting personal data of the training person.

19. Portable device according to claim 7, further comprising a means for receiving personal data of another training person.

20. Portable device according to claim 19, wherein the microprocessor compares the received personal data with the training person's stored personal data and causes output of verbal information if the compared data at least partially match.

21. Training system for optimizing a training comprising:

a sound playback device adapted for playback of music;

a microprocessor;

a detector that detects parameters inherent to the body of a user, said detector being connected with the microprocessor for data communication;

a converter controlled by the microprocessor and connected to the sound playback device for converting the detected values of said parameters into verbal training information for the user and for outputting the information by the sound playback device; and a base station.

22. Training system according to claim 21, wherein the base station is a computer, preferably with Internet access.

23. A system for regulating physical activity of a user comprising:

a sound playback device adapted for playback of music;

a detector that detects parameters inherent to the user's body;

a converter that converts data corresponding to the detected parameters inherent to the user's body into information output by the sound playback device;

the detector being connected to the converter for communicating the data corresponding to the detected parameters inherent to the user's body to the converter; and the converter being connected to the sound playback device for informing the user about the user's present physical condition.

24. The system of claim 23 further comprising a microprocessor for controlling the converter.

25. The system of claim 24 in which the microprocessor has access to a program for controlling output of the sound playback device.

26. The system of claim 25 in which the microprocessor program is responsive to the data corresponding to the detected parameters inherent to the user's body for altering output of the sound playback device.

27. The system of claim 23 in which the converter includes a voice synthesizer for outputting information in a verbal form through the sound playback device.

28. The system of claim 23 in which the detector includes at least one of a pulsimeter and a pulsoxymeter.

29. The system of claim 23 in which the detector includes at least one of a chronometer, a timer, and a pedometer.

* * * * *

US006716139C1

(12) INTER PARTES REEXAMINATION CERTIFICATE (765th)

United States Patent

Hosseinzadeh-Dolkhani et al.

(10) Number: US 6,716,139 C1

(45) Certificate Issued: Dec. 11, 2013

(54) METHOD AND PORTABLE TRAINING DEVICE FOR OPTIMIZING A TRAINING

(75) Inventors: Boris Hosseinzadeh-Dolkhani, Munich (DE); Wolfgang Schiller, Germering (DE); Marc Rummel, Munich (DE)

(73) Assignee: NIKE, Inc., Beaverton, OR (US)

Reexamination Request:
No. 95/001,198, Jun. 29, 2009

Reexamination Certificate for:

| | |
|---|---|
| Patent No.: | **6,716,139** |
| Issued: | **Apr. 6, 2004** |
| Appl. No.: | **09/712,086** |
| Filed: | **Nov. 14, 2000** |

(30) Foreign Application Priority Data

Nov. 16, 1999 (DE) ..... 199 55 720

(51) Int. Cl.
*A63B 69/00* (2006.01)

(52) U.S. Cl.
USPC ..... 482/1; 482/8; 482/9

(58) Field of Classification Search
USPC ..... 482/1, 8, 9
See application file for complete search history.

(56) References Cited

To view the complete listing of prior art documents cited during the proceeding for Reexamination Control Number 95/001,198, please refer to the USPTO's public Patent Application Information Retrieval (PAIR) system under the Display References tab.

*Primary Examiner* — Matthew C. Graham

(57) ABSTRACT

The present invention provides a portable training device for optimizing a training comprising a sound playback means, a microprocessor, and a means for detecting parameters inherent to the body of the user, said detecting means being connected with the microprocessor for data communication. The training device further comprises a converter means controlled by the microprocessor and connected to the sound playback means for converting the detected values of the said parameters into verbal training information for the training person and outputting them by the sound playback means.

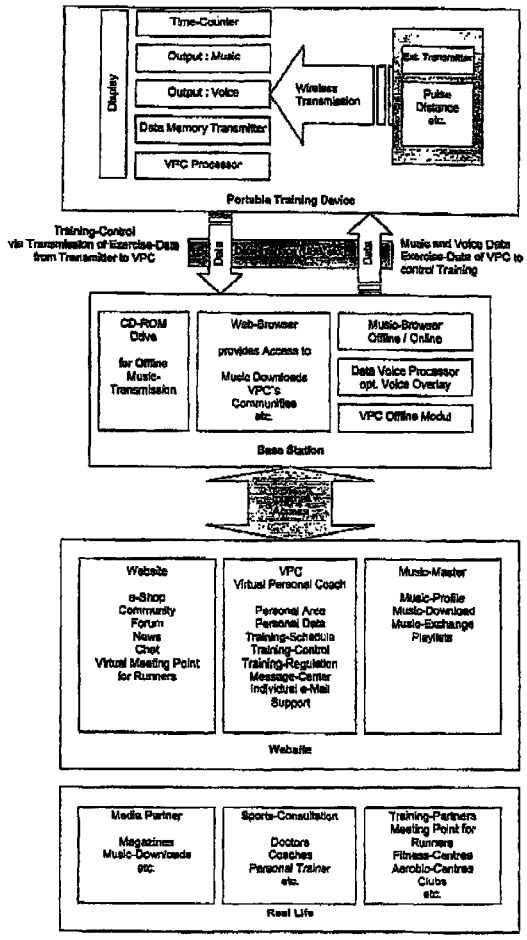

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-29 are cancelled.

* * * * *